US007598933B2

(12) United States Patent
Kim

(10) Patent No.: US 7,598,933 B2
(45) **Date of Patent: *Oct. 6, 2009**

(54) APPARATUS AND METHOD FOR DRIVING PLASMA DISPLAY PANEL TO ENHANCE DISPLAY OF GRAY SCALE AND COLOR

(75) Inventor: Joon-Koo Kim, Seongnam (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 570 days.

This patent is subject to a terminal disclaimer.

(21) Appl. No.: 11/296,535

(22) Filed: Dec. 8, 2005

(65) Prior Publication Data

US 2006/0092103 A1 May 4, 2006

Related U.S. Application Data

(63) Continuation of application No. 10/612,344, filed on Jul. 3, 2003, now Pat. No. 7,025,252.

(30) Foreign Application Priority Data

Jul. 8, 2002 (KR) ..... 2002-39319

(51) Int. Cl.
*G09G 3/28* (2006.01)

(52) U.S. Cl. ..... 345/63; 345/211

(58) Field of Classification Search ..... 345/60–67, 345/211

See application file for complete search history.

(56) References Cited

U.S. PATENT DOCUMENTS 5,541,618 A 7/1996 Shinoda (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Panel 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

*Primary Examiner*—Duc Q Dinh
(74) *Attorney, Agent, or Firm*—Robert E. Bushnell, Esq.

(57) ABSTRACT

The present invention relates to an apparatus and method for driving a PDP (plasma display panel). An image signal processor of the apparatus performs gamma correction and error diffusion processes of input image signals. A quantization error compensator compensates quantization errors with respect to an automatic power control (APC) level of image data output from the image signal processor. An error diffuser sets part of the image data output from the quantization error compensator as display errors and diffuses the display errors to peripheral pixels. A memory control and address driver generates sub-field and address data corresponding to image data that have undergone error diffusion by the error diffuser, and applies the data to the PDP. An APC and sustain/scan pulse generator generates a sub-field arrangement structure according to the APC level, generates control signals based on the generated sub-field arrangement, and applies the control signals to the PDP.

18 Claims, 7 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,790,095 | A | 8/1998 | Onodera et al. | |
| 5,952,782 | A | 9/1999 | Nanto | |
| 6,091,767 | A | 7/2000 | Westerman | |
| 6,310,588 | B1 | 10/2001 | Kawahara et al. | |
| RE37,444 | E | 11/2001 | Kanazawa | |
| 6,625,667 | B1 | 9/2003 | Westerman | |
| 6,630,916 | B1 | 10/2003 | Shinoda | |
| 6,639,605 | B2 * | 10/2003 | Van Dalfsen et al. | 345/690 |
| 6,674,446 | B2 | 1/2004 | Van Dalfsen et al. | |
| 6,707,436 | B2 | 3/2004 | Setoguchi et al. | |
| 6,788,276 | B2 | 9/2004 | Eo | |
| 6,836,263 | B2 * | 12/2004 | Naka et al. | 345/60 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 2002-72956 | 3/2002 |
| KR | 2002-14766 | 2/2002 |

* cited by examiner

APPARATUS AND METHOD FOR DRIVING PLASMA DISPLAY PANEL TO ENHANCE DISPLAY OF GRAY SCALE AND COLOR

CROSS-REFERENCE TO RELATED APPLICATIONS

This application is a continuation of Applicant's Ser. No. 10/612,344 filed in the U.S. Patent & Trademark Office on 3 Jul. 2003, and issued on 11 Apr. 2006 as U.S. Pat. No. 7,025,252, and assigned to the assignee of the present invention.

CLAIM OF PRIORITY

This application makes reference to, incorporates the same herein, and claims all benefits accruing under 35 U.S.C. §119 from an application for APPARATUS AND METHOD FOR DRIVING PLASMA DISPLAY PANEL TO ENHANCE DISPLAY OF GRAY SCALE AND COLOR earlier filed in the Korean Intellectual Property Office on 8 Jul. 2002 and there duly assigned Serial No. 2002-39319, and under 35 U.S.C. §120 from an application for APPARATUS AND METHOD FOR DRIVING PLASMA DISPLAY PANEL TO ENHANCE DISPLAY OF GRAY SCALE AND COLOR earlier filed in the United States Patent & Trademark Office on 3 Jul. 2003 and there duly assigned Ser. No. 10/612,344.

BACKGROUND OF THE INVENTION

1. Field of the Invention

The present invention relates to a plasma display panel. More particularly, the present invention relates to an apparatus and method for driving a plasma display panel to enhance the display of gray scale and color.

2. Description of the Related Art

A plasma display panel (PDP) is a display device in which a plurality of discharge cells are arranged in a matrix, and the discharge cells are selectively illuminated to restore image data, which are input as electrical signals.

In such a PDP, a plurality of scan electrodes and sustain electrodes are formed with at least one pair opposing one another in parallel, and at least one address electrode is formed at a predetermined distance from these electrodes and orthogonal to the same. A pulse voltage is applied to at least one of the scan electrodes and the sustain electrodes, and an address voltage is applied to the address electrode. As a result, discharge occurs between the address electrodes and the scan electrodes and/or the sustain electrodes to thereby realize an address operation that provides variations in electrical properties where these electrodes intersect. Also, a sustain operation is performed in which a sustain voltage is applied between the scan electrodes and the sustain electrodes following discharge such that discharge occurs only at locations where variations in electrical properties arise between the scan electrodes and the sustain electrodes.

In such a PDP, the display of gray scale must be possible in order to exhibit the capabilities of a color display device. A method is used to achieve this, in which a single field is divided into a plurality of sub-fields and the sub-fields are controlled by a process of time sharing.

The drive characteristics of PDPs are such that a high amount of power is consumed during operation. Therefore, an automatic power control (APC) technique is used in which the amount of power consumed is controlled according to a load ratio (or an ASL(average signal level)) of a displayed frame. That is, in the APC technique, the power consumed is limited to below a predetermined level while the number of sustain pulses is varied according to the load ratio of input image data.

With the use of the APC technique, the number of sustain pulses operating on each sub-field is varied according to the load ratio. In particular, depending on the load ratio, the number of total sustain pulses applied in 1TV frame is varied such that each sub-field has a number of sustain pulses corresponding to a gray scale display weight that the sub-field has. Therefore, the number of sustain pulses operating on each sub-field also varies.

In the ideal case, in order to realize a linear relation between gray scale and the number of sustain pulses, the number of sustain pulses must be a real number. However, in practice, the number of sustain pulses must be an integer to realize such an outcome, in which case a quantization error results during generation of the number of sustain pulses.

For example, a number $n_{ij}$ of sustain pulses of a jth APC level of an actual ith sub-field is obtained as shown in Equation 1 below.

$$n_{ij} = \frac{w_i}{\sum_{i=1}^{N_{sf}} w_i} N_{TOTj} \qquad \text{[Equation 1]}$$

where $W_i$ is a gray scale display weight of an ith sub-field, $N_{sf}$ is a number of sub-fields, and $N_{TOTj}$ is a total number of sustain pulses of a jth APC level.

The number $n_{ij}$ of sustain pulses calculated using Equation 1 above is either an integer or a real number, whereas the number of sustain pulses used in practice is an integer. Therefore, during actual PDP driving, the number $n_{ij}$ is rounded to the nearest whole number to obtain the number $N_{ij}$. The quantization error resulting from such rounding is expressed as $\delta N_{ij}$. The corresponding relation is shown in Equation 2 below.

$$N_{ij} = \text{Round}(n_{ij})$$

$$n_{ij} = N_{ij} + \delta N_{ij} \qquad \text{[Equation 2]}$$

Accordingly, with respect to the jth APC level, a designated total number of sustain pulses and a total number of sustain pulses actually obtained are not the same, and a difference between these amounts may be expressed as a sum of the quantization errors as shown in Equation 3 as follows.

$$N_{TOTj} - \sum_{i=1}^{N_{sf}} N_{ij} = \sum_{i=1}^{N_{sf}} \delta N_{ij} \neq 0 \qquad \text{[Equation 3]}$$

Quantization error rates with respect to each APC level are shown in FIG. 1. It is clear from the drawing that the larger the load ratio of the screen, the greater the spread in the quantization error rate during load ratio variations.

The gray scale display weights of the sub-fields for the different load rates become slightly distorted by the quantization errors. This causes a reduction in the ability to display gray scale such that gray scale colors are distorted according to load ratio variations. As shown in FIGS. 2A and 2B, compared to before quantization, colors are distorted following quantization when the APC levels are converted at the same gray levels when displaying low gray levels.

While driving the PDP, if gamma correction is performed, which is reverse correction of gray scale correction with respect to digital image data, gray scale in the displayed image that is low in brightness is significantly lowered to thereby deteriorate picture quality. To remedy this problem, Korean Laid-Open Patent No. 2002-14766 discloses a technique in which error components of gray scale displayed following an increase in gray scale during gamma correction are diffused to adjacent pixels. As an example, in the case where image data input for gamma correction are 8 bits, data output through gamma correction are converted to data of 12 bits. Subsequently, the lower 4 bits of the 12 bits are separated by error diffusion and diffused to an adjacent pixel such that ultimately 8-bit data able to display low gray scale are input to the PDP.

However, in such a conventional method, compensation with respect to quantization errors occurring when the APC technique is applied as described above is not performed, and the errors caused by the inaccuracy in the number of sustain pulses are diffused to an adjacent pixel. As a result, a rate at which the consumed power varies according to the load ratio lacks uniformity.

SUMMARY OF THE INVENTION

It is therefore, an object to provide an apparatus and method for driving a plasma display panel in which quantization errors generated when an APC technique is applied are compensated, and the obtained errors are diffused to adjacent pixels to thereby improve the display of gray scale and color.

It is another object to provide a display device where the distortion of sub-field weights according to load ratio occurring as a result of quantization errors when an APC technique is applied is reduced such that gray scale display becomes more natural.

It is yet another object to provide a display device where by diffusing to adjacent pixels errors obtained through quantization error compensation, an improvement in the display of gray scale and colors is realized.

In one embodiment, the present invention is an apparatus and method for driving a plasma display panel in which quantization errors generated when an APC technique is applied are compensated, and the obtained errors are diffused to adjacent pixels to thereby improve the display of gray scale and color.

In the apparatus for driving a plasma display panel, images of each field displayed on the plasma display panel corresponding to input image signals are divided into a plurality of sub-fields of differing weights, and weight values of these sub-fields are combined to display gray scale. The apparatus includes an image signal processor performing gamma correction and error diffusion processes of the input image signals; a quantization error compensator compensating quantization errors with respect to an automatic power control (APC) level of image data output from the image signal processor, and outputting resulting image data; an error diffuser setting part of the image data output from the quantization error compensator as display errors and diffusing the display errors to peripheral pixels; a memory control and address driver generating sub-field data and address data corresponding to image data that have undergone error diffusion by the error diffuser, and applying the sub-field data and the address data to the plasma display panel; and an APC and sustain/scan pulse generator that generates a sub-field arrangement structure according to the APC level of image data output from the image signal processor, generates control signals based on the generated sub-field arrangement, and applies the control signals to the plasma display panel.

The quantization error compensator includes a frame buffer delaying then outputting the image data output from the image signal processor; an APC level detector detecting a load ratio of the image data output from the image signal processor, and calculating the APC level; a quantization error lookup table outputting a quantization error compensation amount with respect to a number of sustain pulses for each gray scale by using the APC level calculated in the APC level detector; and an error compensator compensating the image data output from the frame buffer by a quantization error compensation amount output from the quantization error lookup table.

Further, the error compensator includes an expander expanding a width of the image data output from the frame buffer, and outputting resulting image data; and a compensator compensating the image data expanded by the expander by a quantization error compensation amount.

In the method for driving a plasma display panel, images of each field displayed on the plasma display panel corresponding to input image signals are divided into a plurality of sub-fields of differing weights, and weight values of these sub-fields are combined to display gray scale. The method includes performing gamma correction and error diffusion processes of the input image signals, and generating corresponding image data; compensating quantization errors according to an automatic power control (APC) level of the generated image data; performing an error diffusion process with respect to the image data having undergone quantization error compensation; and performing an addressing operation of the plasma display panel according to the image data having undergone the error diffusion process.

Compensating quantization errors includes detecting a load ratio of the generated image data and calculating an APC level; obtaining a quantization error compensation amount with respect to a number of sustain pulses for each gray scale, the quantization error compensation amount being obtained based on the calculated APC level; and compensating the generated image data by the quantization error compensation amount.

Further, compensating the generated image data by the quantization error compensation amount includes enlarging a width of the generated image data; and compensating the enlarged image data by the quantization error compensation amount.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Embodiments of the present invention will now be described in detail with reference to the accompanying drawings. It is to be understood that the structure of the present invention is useful not only for field emission displays, but also for similar flat panel displays.

Figure 1:
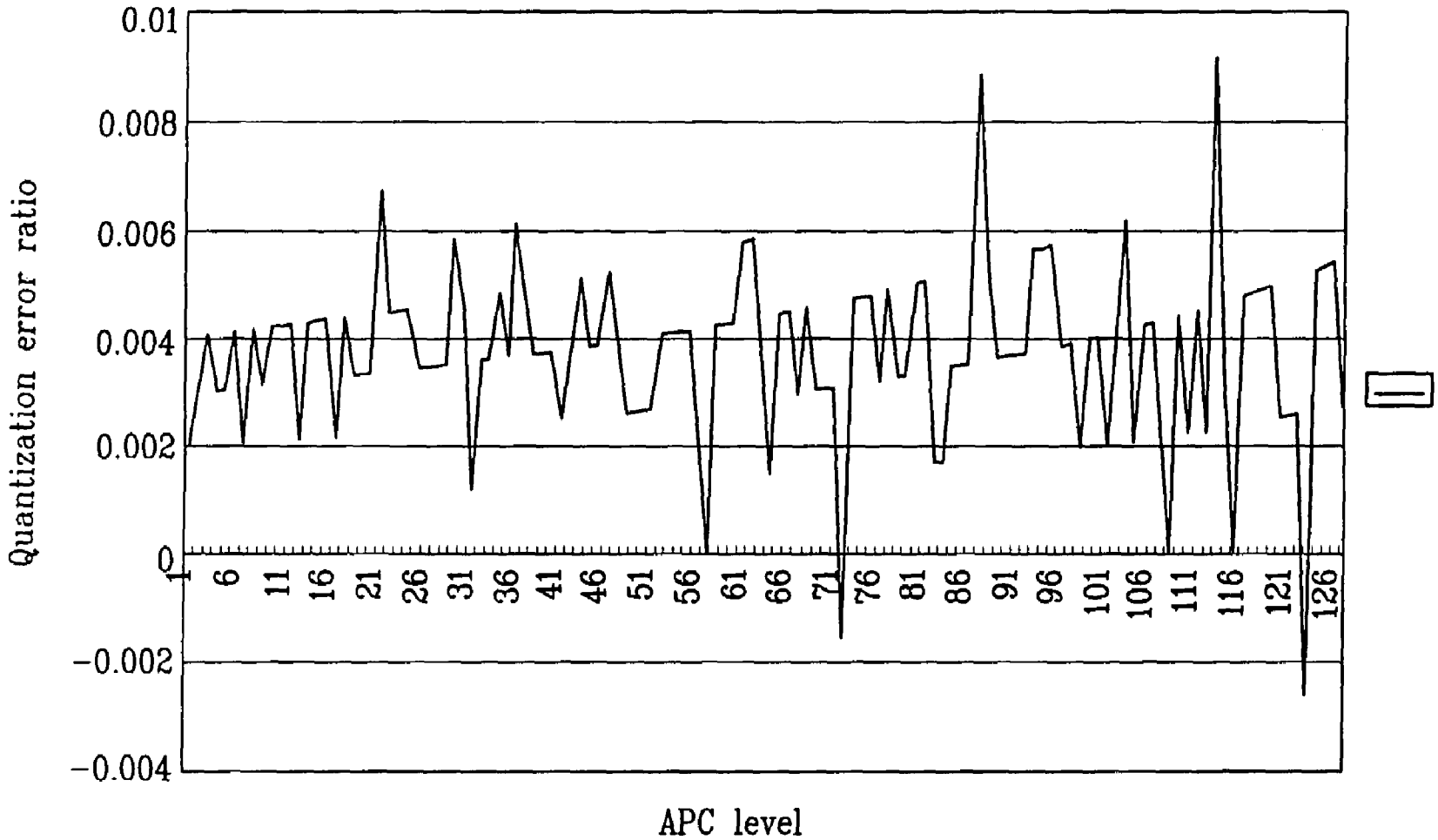
FIG. 1 is a graph showing a quantization error rate according to APC level.
Figure 2A:
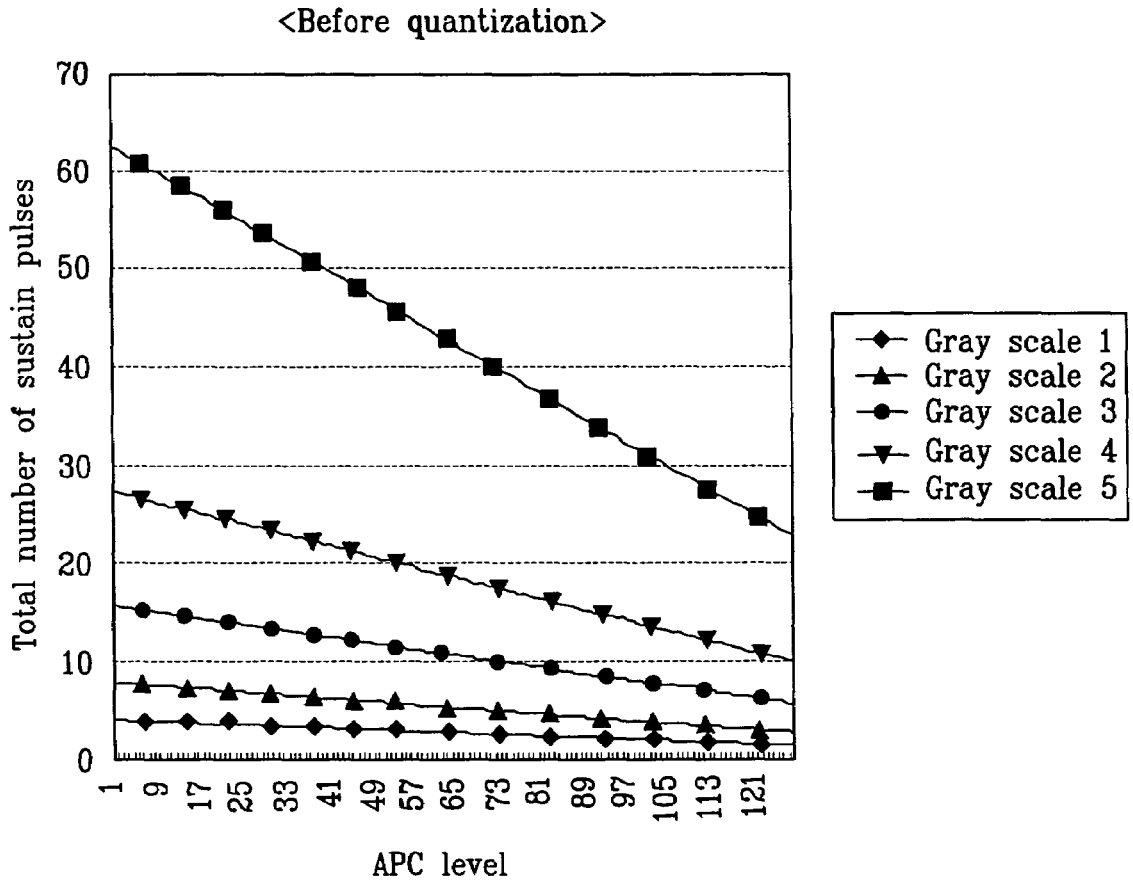
FIGS. 2A and 2B are graphs showing a total number of sustain pulses according to APC level respectively before and after quantization.
Figure 2B:
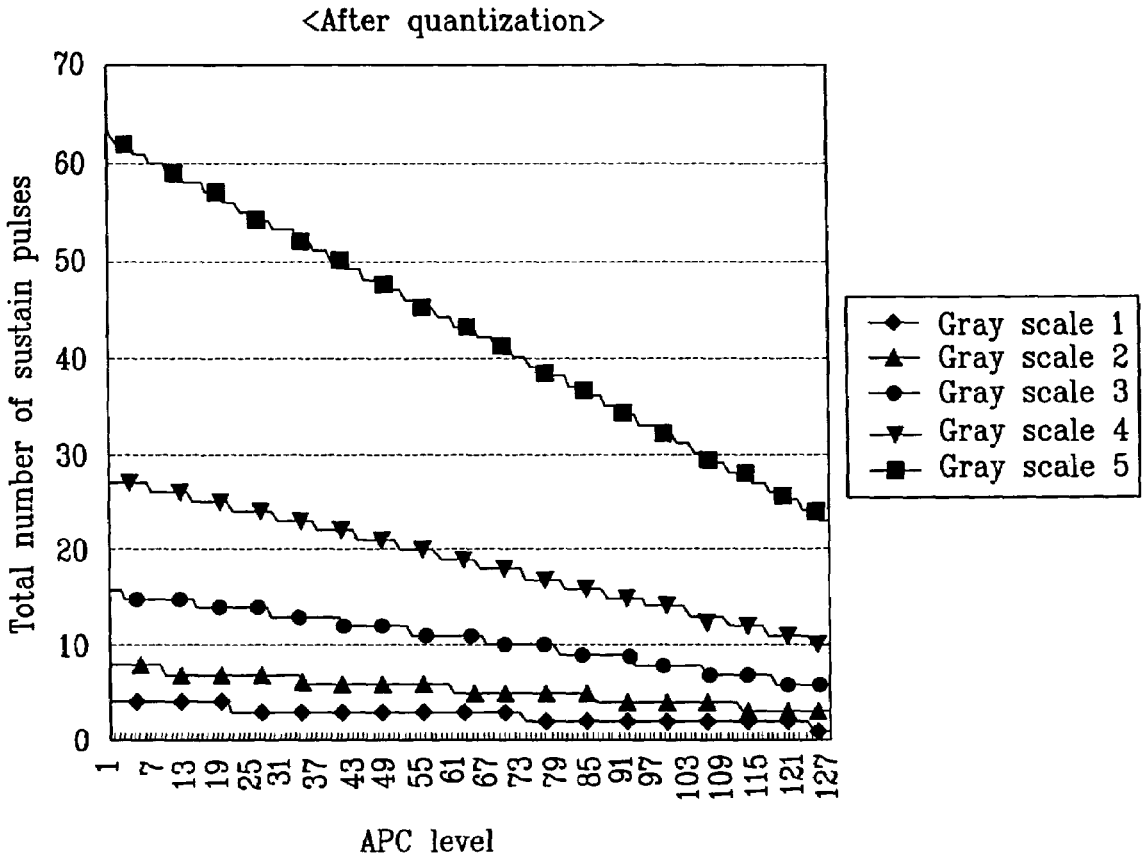
Figure 3:
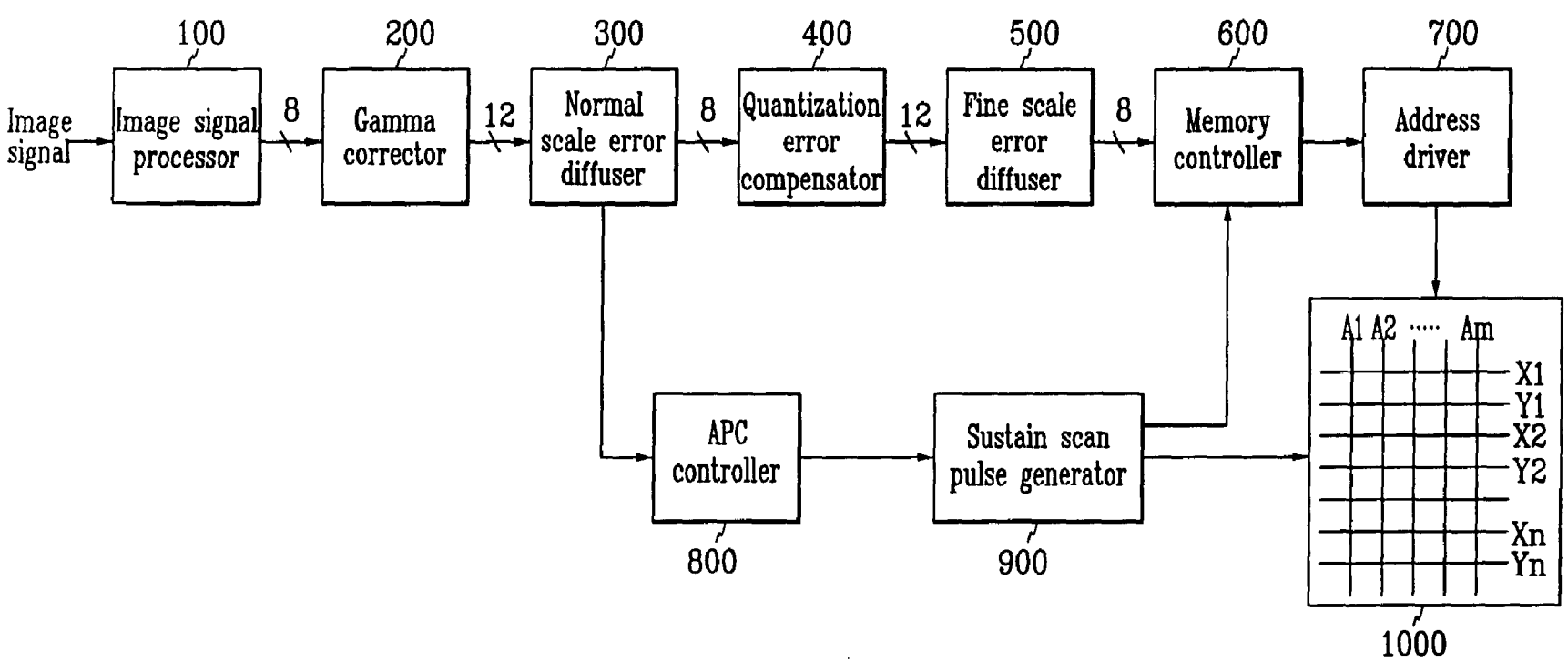
FIG. 3 is a block diagram of an apparatus for driving a plasma display panel according to an embodiment of the present invention.

FIG. 3 is a block diagram of an apparatus for driving a plasma display panel according to an embodiment of the present invention.

As shown in the drawing, an apparatus for driving a plasma display panel (PDP) includes an image signal processor 100, a gamma corrector 200, a normal scale error diffuser 300, a quantization error compensator 400, a fine scale error diffuser 500, a memory controller 600, an address driver 700, an APC controller 800, and a sustain/scan pulse generator 900.

The image signal processor 100 generates and outputs digital image data corresponding to externally received image signals. The digital image data that are output are 8-bit data.

The gamma corrector 200 performs gamma correction (actually gamma reverse correction) corresponding to reverse correction of gamma correction to maintain compatibility with the illumination characteristics of a cathode ray tube. The gamma corrector 200 performs gamma correction with respect to 8-bit image data output from the image signal processor 100, and outputs 12-bit data.

The normal scale error diffuser 300 applies display errors, which are diffused from peripheral pixels, with respect to the 12-bit data output from the gamma corrector to thereby generate 8-bit image data. Since the normal scale error diffuser 300 performs conventional error diffusion processes, a detailed description thereof will not be provided.

A quantization error compensator 400 receives the 8-bit image data output from the normal scale error diffuser 300 and expands the data to 12-bit data. The quantization error compensator 400 also performs quantization error compensation processes according to APC level with respect to the expanded 12-bit data.

A fine scale error diffuser 500 applies display errors, which are diffused from peripheral pixels, with respect to the 12-bit data output from the quantization error compensator 400 to thereby generate 8-bit image data. Although the fine scale error diffuser 500 performs the same error diffusion process as the normal scale error diffuser 300, that is, the conventional error diffusion process, since the fine scale error diffuser 500 performs an error diffusion process with respect to data that has undergone quantization error compensation in the error compensator 400, a more minute error diffusion process is performed when compared to the conventional process.

The memory controller 600 generates sub-field data corresponding to the 8-bit image data output from the fine scale error diffuser 500 according to a control signal output by the sustain/scan pulse generator 900.

The address driver 700 generates address data corresponding to the sub-field data output from the memory controller 600, and applies the address data to address electrodes (A1, A2, . . . Am) of a plasma display panel (PDP) 1000.

The APC controller 800 detects a load ratio using the 8-bit image data output from the normal scale error diffuser 300, and calculates an APC level according to the detected load ratio. The APC controller 800 also calculates a number of sustain pulses corresponding to the calculated APC level and an address pulse width of each sub-field.

The sustain/scan pulse generator 900 receives the number of sustain pulses and address pulse width of each sub-field from the APC controller 800, and generates a corresponding sub-field arrangement structure, and a control signal for the operation of the memory controller 600. The sustain/scan pulse generator 900 also generates sustain pulses and scan pulses based on the generated sub-field arrangement structure, and applies these pulses respectively to sustain electrodes (X1, X2, . . . Xn) and scan electrodes (Y1, Y2, . . . Yn) of the PDP 1000.

Figure 4:
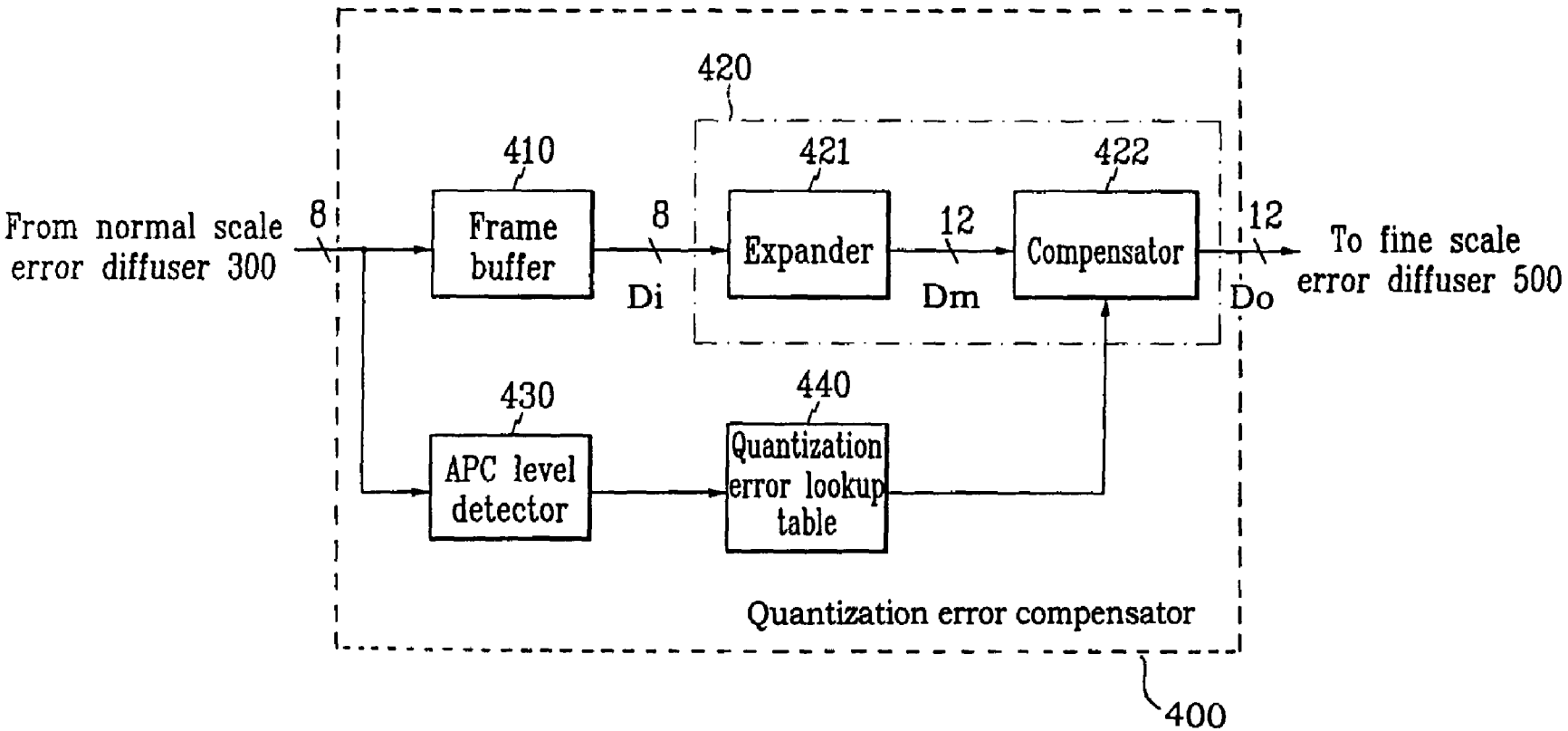
FIG. 4 is a detailed block diagram of a quantization error compensator of FIG. 3.

FIG. 4 is a detailed block diagram of the quantization error compensator 400 of FIG. 3.

With reference to the drawing, the quantization error compensator 400 includes a frame buffer 410, an error compensator 420, an APC level detector 430, and a quantization error lookup table 440.

The frame buffer 410 delays the 8-bit image data output from the normal scale error diffuser 300 by one frame before outputting the data.

The APC level detector 430 detects the load ratio using the 8-bit image data output from the normal scale error diffuser 300, and calculates the APC level according to the load ratio. The APC controller 800 may also be used for these operations since they are performed by the APC controller 800.

The quantization error lookup table 440 stores quantization error compensation amounts according to the number of sustain pulses depending on gray scale based on APC level. The quantization error lookup table 440 receives the APC level calculated in the APC level detector 430 and outputs a quantization error compensation amount with respect to the number of sustain pulses of the corresponding gray scale. The quantization error compensation amount with respect to the number of sustain pulses depending on gray scale is determined from Equation 4 below.

$$\frac{\sum_{i=1}^{N_{sf}} \delta N_{ij}}{N_{TOTj}} \cdot \sum_{i=1}^{N_{sf}} w_i \qquad \text{[Equation 4]}$$

Figure 5A:
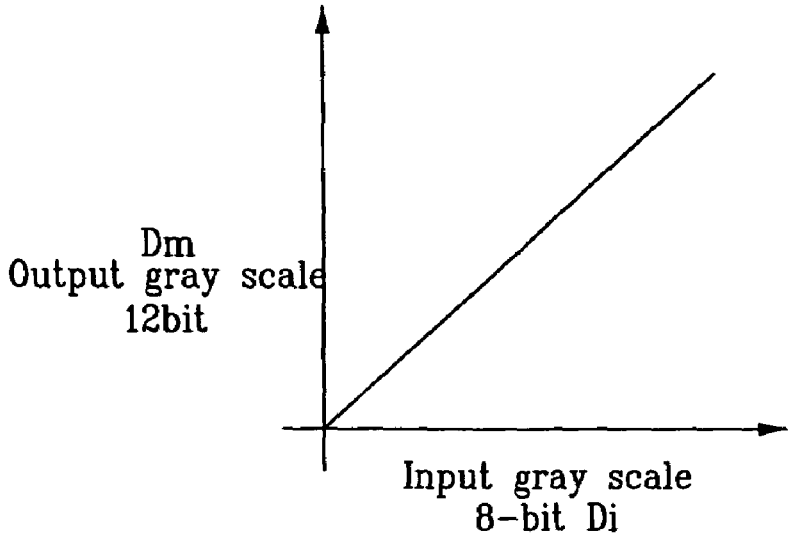
FIG. 5A is a graph showing an expansion relation of data input from an expander of FIG. 4.
Figure 5B:
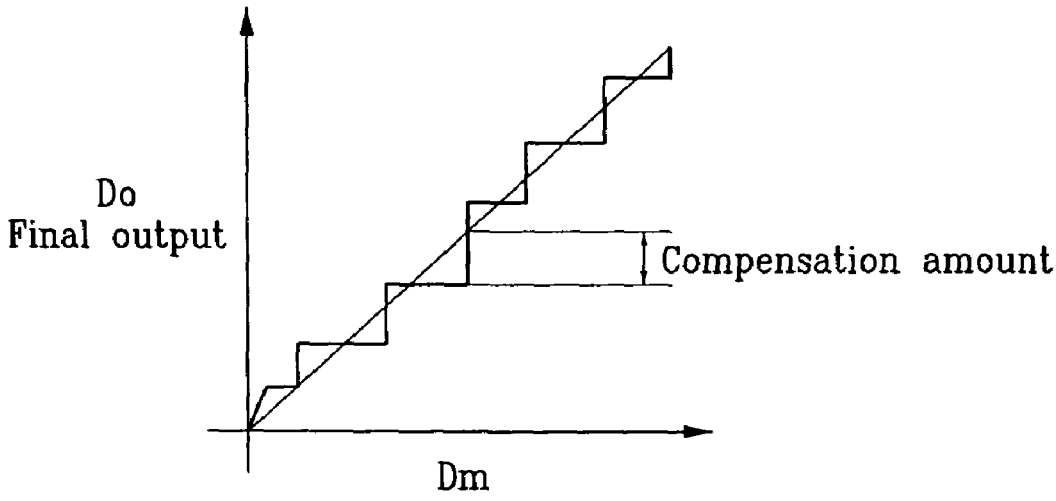
FIG. 5B is a graph showing a compensation relation of data input from a compensator of FIG. 4.

Referring to FIGS. 4 and 5A, the error compensator 420 includes an expander 421 that expands the 8-bit image data Di output from the frame buffer 410 to 12-bit image data Dm. Referring to FIGS. 4 and 5B, the error compensator 420 includes a compensator 422 that performs compensation of a quantization error amount output from the quantization error lookup table 440 with respect to 12-bit image data Dm output from the expander 421, and outputs 12-bit compensated image data Do to the fine scale error diffuser 500.

A method for driving a PDP that improves the display of gray scale and color according to an embodiment of the present invention will now be described.

Image signals to be displayed on a screen by the PDP 1000 are converted into 8-bit digital image data by the image signal processor 100. Next, gamma correction corresponding to reverse correction of gamma correction to maintain compatibility with CRT (cathode-ray tube) illumination characteristics is performed by the gamma corrector 200 such that the 8-bit digital image data are output to the normal scale error diffuser 300 as 12-bit image data.

At the same time data of the lower 4 bits of the 12-bit image data input to the normal scale error diffuser 300 are diffused to peripheral pixels as display errors, the 12-bit image data are output as 8-bit image data following the application of display errors diffused and received from peripheral pixels to corresponding image data to perform normal scale error diffusion, and the 12-bit image data are output as 8-bit image data.

Next, the 8-bit image data output from the normal scale error diffuser 300 is delayed by one frame in the frame buffer 410 of the quantization error compensator 400, input to the expander 421 of the error compensator 420, then enlarged as 12-bit image data as shown in FIG. 5A and output.

The 8-bit image data output from the normal scale error diffuser 300 is input also to the APC level detector 430 of the quantization error compensator 400 where the data is used to determine the APC level. The APC level determined in this manner is input to the quantization error lookup table 440 to form the basis for determining the sustain pulse quantization error compensation amount according to gray scale.

The quantization error compensation amount determined in the quantization error lookup table 440 is input to the compensator 422 of the error compensator 420. The 12-bit image data enlarged by the expander 421 are also input to the compensator 422.

The compensator 422 receives a quantization error compensation amount from the quantization error lookup table 440, and compensates and outputs 12-bit image data expanded in and output from the expander 421.

Quantization errors are compensated by the error compensator 420 in this manner. Also, at the same time data of the lower 4 bits of the 12-bit image data input to the fine scale error diffuser 500 are diffused to peripheral pixels as display errors, the 12-bit image data are output as 8-bit image data (following the application of display errors diffused and received from peripheral pixels) to corresponding image data to perform normal scale error diffusion, and the 12-bit image data are output as 8-bit image data to the memory controller 600.

Accordingly, image data that have undergone quantization error compensation by the quantization error compensator 400 are error diffused by the fine scale error diffuser 500 to thereby realize error diffusion compensation with respect to quantization errors.

Subsequently, sub-field data are generated in the memory controller 600 with respect to 8-bit image data output from the fine scale error diffuser 500. Also, the address driver 700 generates address data corresponding to sub-field data output from the memory controller 600 and applies the data to the address electrodes (A1, A2, . . . Am) of the PDP 1000.

Using the 8-bit image data output from the normal scale error diffuser 300, the APC controller 800 calculates the APC level, and determines and outputs the number of sustain pulses corresponding to the calculated APC level. The sustain/scan pulse generator 900 receives the number of sustain pulses output from the APC controller 800 and generates a corresponding sub-field arrangement structure. The sustain/scan pulse generator 900 also generates sustain pulses and scan pulses based on the produced sub-field arrangement, then applies the same respectively to the sustain electrodes (X1, X2, . . . Xn) and the scan electrodes (Y1, Y2, . . . Yn) of the PDP 1000.

Address data are applied to the PDP 1000 from the address driver 700, and sustain pulses and scan pulses are applied to the PDP 1000 from the sustain/scan pulse generator 900 as described above. As a result, an image corresponding to the input image signals may be displayed on the PDP 1000.

The present invention can be also realized as computer-executable instructions in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), rewritable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The present invention can include the computer-readable medium having stored thereon a data structure including a plurality of fields containing data representing the techniques of the present invention.

Figure 6:
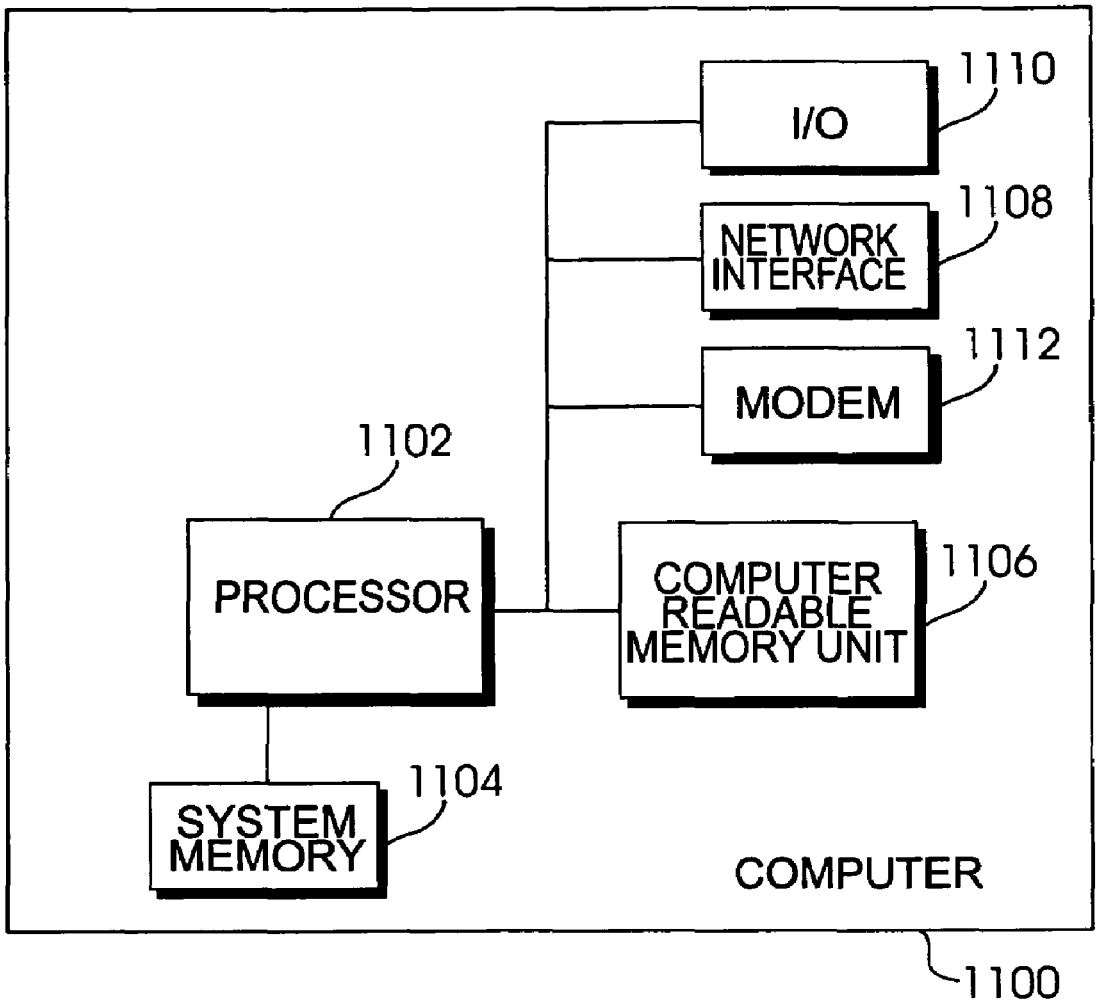
FIG. 6 shows an example of a computer including a computer-readable medium having computer-executable instructions for performing a method of the present invention.

An example of a computer, but not limited to this example of the computer, that can read computer readable media that includes computer-executable instructions of the present invention is shown in FIG. 6. The computer 1100 includes a processor 1102 that controls the computer 1100. The processor 1102 uses the system memory 1104 and a computer readable memory device 1106 that includes certain computer readable recording media. A system bus connects the processor 1102 to a network interface 1108, modem 1112 or other interface that accommodates a connection to another computer or network such as the Internet. The system bus may also include an input and output interface 1110 that accommodates connection to a variety of other devices.

In the apparatus and method for driving a plasma display panel of the present invention described above, the distortion of sub-field weights according to load ratio occurring as a result of quantization errors when an APC technique is applied is reduced such that gray scale display becomes more natural. Further, by diffusing to adjacent pixels errors obtained through quantization error compensation, an improvement in the display of gray scale and colors is realized.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An apparatus for driving a plasma display panel, comprising:

a quantization error compensator compensating quantization errors with respect to an automatic power control level of image data output, and outputting resulting image data; and an error diffuser setting part of the image data output from the quantization error compensator as display errors and diffusing the display errors to peripheral pixels.

2. The apparatus of claim 1, wherein the quantization error compensator comprises:

a frame buffer delaying the image data output by a frame and outputting the same;

an automatic power control level detector detecting a load ratio of the image data output, and calculating the automatic power control level;

a quantization error lookup table outputting a quantization error compensation amount with respect to a number of sustain pulses for each gray scale by using the automatic power control level calculated in the automatic power control level detector; and an error compensator compensating the image data output from the frame buffer by a quantization error compensation amount output from the quantization error lookup table.

3. The apparatus of claim 2, wherein the error compensator comprises:

an expander expanding a width of the image data output from the frame buffer, and outputting resulting image data; and a compensator compensating the image data expanded by the expander by a quantization error compensation amount.

4. The apparatus of claim 2, wherein the quantization error compensation amount is calculated by the following expression:

$$\frac{\sum_{i=1}^{N_{sf}} \delta N_{ij}}{N_{TOTj}} \cdot \sum_{i=1}^{N_{sf}} w_i$$

where j is the automatic power control level of image data, $W_i$ is a weight of an ith sub-field, $N_{sf}$ is a number of sub-fields, $N_{TOTj}$ is a total number of sustain pulses of a jth automatic power control level, and $\delta N_{ij}$ is a quantization error of an ith sub-field in a jth automatic power control level.

5. The apparatus of claim 3, wherein 8-bit image data are expanded into 12-bit image data by the expander.

6. The apparatus of claim 5, wherein the error expander performs diffusion of lower 4 bits of the 12-bit image data output from the expander as display errors.

7. The apparatus of claim 3, with the compensator performing compensation of a quantization error amount output from the quantization error lookup table with respect to image data output from the expander, and outputting compensated image data to the error diffuser.

8. The apparatus of claim 1, further comprising a memory controller generating sub-field data corresponding to the image data output from said error diffuser according to a control signal output by a sustain and scan pulse generator.

9. The apparatus of claim 1, wherein said quantization error compensator comprises an error compensator compensating the image data output from a delayed image from an image signal processor by a quantization error compensation amount output from a quantization error lookup table.

10. The apparatus of claim 9, wherein the quantization error compensation amount is calculated by the following expression:

$$\frac{\sum_{i=1}^{N_{sf}} \delta N_{ij}}{N_{TOTj}} \cdot \sum_{i=1}^{N_{sf}} w_i$$

where j is the automatic power control level of image data, $W_i$ is a weight of an ith sub-field, $N_{sf}$ is a number of sub-fields, $N_{TOTj}$ is a total number of sustain pulses of a jth automatic power control level, and $\delta N_{ij}$ is a quantization error of an ith sub-field in a jth automatic power control level.

11. The apparatus of claim 10, wherein the error compensator comprises:

an expander expanding a width of the image data output from the frame buffer, and outputting resulting image data; and a compensator compensating the image data expanded by the expander by a quantization error compensation amount.

12. A method for driving a plasma display panel the method comprising:

providing the plasma display panel in which images of each field displayed on the plasma display panel corresponding to input image signals are divided into a plurality of sub-fields ofdiffering weights, and weight values of these sub-fields are combined to display gray scale;

compensating quantization errors according to an automatic power control level of a generated image data; and performing an error diffusion process with respect to the image data having undergone quantization error compensation.

13. The method of claim 12, wherein compensating quantization errors comprises:

detecting a load ratio of the generated image data and calculating an automatic power control level;

obtaining a quantization error compensation amount with respect to a number of sustain pulses for each gray scale, the quantization error compensation amount being obtained based on the calculated automatic power control level; and compensating the generated image data by the quantization error compensation amount.

14. The method of claim 13, wherein compensating the generated image data by the quantization error compensation amount comprises:

expanding a width of the generated image data; and compensating the enlarged image data by the quantization error compensation amount.

15. An apparatus for driving a display panel, comprising:

a first unit compensating quantization errors with respect to an automatic power control level of image data output, and outputting resulting image data; and a second unit setting part of the image data output from said first unit as display errors and diffusing the display errors to peripheral pixels.

16. The apparatus of claim 15, wherein said first unit comprises:

a first sub-unit delaying the image data output by a frame and outputting the same; and a second sub-unit detecting a load ratio of the image data output, and calculating the automatic power control level.

17. The apparatus of claim 16, wherein said first unit further comprises a third sub-unit outputting a quantization error compensation amount with respect to a number of sustain pulses for each gray scale by using the automatic power control level calculated in said second sub-unit.

18. The apparatus of claim 17, wherein said first unit further comprises a fourth sub-unit compensating the image data output from said first sub-unit by a quantization error compensation amount output from said third sub-unit.

* * * * *